US006811871B2

(12) United States Patent
Sen et al.

(10) Patent No.: US 6,811,871 B2
(45) Date of Patent: Nov. 2, 2004

(54) ELASTIC BICOMPONENT AND BICONSTITUENT FIBERS, AND METHODS OF MAKING CELLULOSIC STRUCTURES FROM THE SAME

(75) Inventors: Ashish Sen, Midland, MI (US); John Klier, Midland, MI (US); Rexford A. Maugans, Lake Jackson, TX (US); Kenneth Stewart, Jr., Lake Jackson, TX (US)

(73) Assignee: Dow Global Technologies Inc., Midland, MI (US)

( * ) Notice: Subject to any disclaimer, the term of this patent is extended or adjusted under 35 U.S.C. 154(b) by 0 days.

(21) Appl. No.: 10/799,168

(22) Filed: Mar. 12, 2004

(65) Prior Publication Data

US 2004/0170831 A1 Sep. 2, 2004

Related U.S. Application Data

(62) Division of application No. 10/195,279, filed on Jul. 15, 2002.
(60) Provisional application No. 60/306,003, filed on Jul. 17, 2001.

(51) Int. Cl.[7] ..... D01F 6/00
(52) U.S. Cl. ..... 428/357; 428/362; 428/373
(58) Field of Search ..... 428/357, 362, 428/373; 526/348.1

(56) References Cited

U.S. PATENT DOCUMENTS

| | | | | |
|---|---|---|---|---|
| 3,236,917 | A | 2/1966 | Natta et al. | 260/878 |
| 3,554,862 | A | 1/1971 | Hervey et al. | 162/158 |
| 3,560,292 | A | 2/1971 | Butter | 156/229 |
| 3,930,933 | A | 1/1976 | George et al. | 162/179 |
| 4,144,122 | A | 3/1979 | Emanuelsson et al. | 162/158 |
| 4,160,059 | A | 7/1979 | Samejima | 428/288 |
| 4,190,602 | A | 2/1980 | Brunisholz et al. | 260/590 |
| 4,816,094 | A | 3/1989 | Pomplun et al. | 156/85 |
| 4,880,682 | A | 11/1989 | Hazelton et al. | 428/152 |
| 4,950,541 | A | 8/1990 | Tabor et al. | 428/373 |
| 5,194,509 | A | 3/1993 | Hasenbein et al. | 525/285 |
| 5,429,856 | A | 7/1995 | Krueger et al. | 604/370 |
| 5,456,982 | A | 10/1995 | Hansen et al. | 428/370 |
| 5,645,542 | A | 7/1997 | Anjur et al. | 604/368 |
| 5,797,895 | A | 8/1998 | Widlund et al. | 604/385.2 |
| 6,140,442 | A | 10/2000 | Knight et al. | 526/348.1 |
| 6,225,243 | B1 | 5/2001 | Austin | 442/361 |
| 6,436,534 | B1 | 8/2002 | Knight et al. | 428/365 |
| 6,448,355 | B1 | 9/2002 | Knight | 526/348 |

FOREIGN PATENT DOCUMENTS

| | | | |
|---|---|---|---|
| EP | 0 465 203 A1 | 1/1992 | D04H/1/54 |
| EP | 0 859 073 A1 | 8/1998 | D01F/8/06 |
| JP | 61194221 | 8/1986 | |
| JP | 11-151782 | 6/1999 | B32B/25/08 |
| JP | 2000212866 | 8/2000 | |

*Primary Examiner*—N. Edwards
(74) *Attorney, Agent, or Firm*—Whyte Hirschboeck Dudek SC

(57) ABSTRACT

The elasticity of elastic, absorbent structures, e.g., diapers, is improved without a significant compromise of the absorbency of the structure by the use of bicomponent and/or biconstituent elastic fiber. The absorbent structures typically comprise a staple fiber, e.g., cellulose fibers, and a bicomponent and/or a biconstituent elastic. The bicomponent fiber typically has a core/sheath construction. The core comprises an elastic thermoplastic elastomer, preferably a TPU, and the sheath comprises a homogeneously branched polyolefin, preferably a homogeneously branched substantially linear ethylene polymer. In various embodiments of the invention, the elasticity is improved by preparation techniques that enhance the ratio of elastic fiber:cellulose fiber versus cellulose fiber:cellulose fiber bonding. These techniques include wet and dry high intensity agitation of the elastic fibers prior to mixing with the cellulose fibers, deactivation of hydrogen bonding between cellulose fibers, and grafting the elastic fiber with a polar group containing compound, e.g. maleic anhydride.

4 Claims, No Drawings

ELASTIC BICOMPONENT AND BICONSTITUENT FIBERS, AND METHODS OF MAKING CELLULOSIC STRUCTURES FROM THE SAME

CROSS-REFERENCE TO RELATED APPLICATIONS

This application is a division of U.S. patent application Ser. No. 10/195,279, filed Jul. 15, 2002, which claims benefit of U.S. Provisional Application No. 60/306,003, filed Jul. 17, 2001.

FIELD OF THE INVENTION

This invention relates to elastic fibers. In one aspect, the invention relates to bicomponent elastic fibers while in another aspect, the invention relates to biconstituent elastic fibers. In another aspect, the invention relates to bicomponent and biconstituent elastic fibers having a core/sheath construction. In yet another aspect, the invention relates to such fibers in which the polymer that forms the sheath has a lower melting point than the polymer that forms the core. In still another embodiment, the invention relates to methods of forming elastic cellulosic structures from a combination of cellulosic fibers and elastic bicomponent and/or biconstituent fibers having a core/sheath construction.

BACKGROUND OF THE INVENTION

Cellulosic structures are known for their absorbency, and this property makes these structures useful in a wide variety of applications. Typical examples of such applications are diapers, wound dressings, feminine hygiene products, bed pads, bibs, wipes, and the like. The purpose of these products, of course, is to absorb and retain liquids, and the efficiency of these products in performing these tasks is determined, in large part, by their structure. U.S. Pat. Nos. 4,816,094, 4,880,682, 5,429,856 and 5,797,895 describe various such products, their construction and the materials from which they are made, and each is incorporated herein by reference.

Typically, absorbent cellulosic structures are made of materials that do not easily stretch. For example, cellulose fibers are, for all intent and purpose, inelastic and in many cellulosic structures, e.g. a diaper, they are bonded to one another in a relatively inelastic manner, e.g., through the use of a latex. Unfortunately, many of these structures require some degree of elasticity for reasons of comfort and use, e.g., a diaper conforming to the contours of the human body or a wipe having the touch and drape of cloth, and if the structure is not sufficiently elastic, gaps will form within it. Gaps reduce the absorbency of the structure by preventing the migration of the liquid to all parts of the structure.

Demand exists for better form-fitting absorbent products. This usually means that not only must the products have improved elasticity, but they must also be thin and light. Elasticity has been chased to date by adding to or replacing some of the cellulose fibers with an elastic fiber. For example, U.S. Pat. No. 5,645,542 to Anjur et al., the disclosure of which is incorporated herein by reference, describes absorbent products made from a wettable staple fiber (e.g., cellulose fiber) and a thermoplastic elastic fiber, e.g., a polyolefin rubber. However, the mere blending of staple fibers with elastic fibers often is not enough to obtain the full benefit of the elastic fiber without compromising the absorbency of the staple fiber. Cellulose fibers (the commonest of the staple fibers) tend to adhere to one another as opposed to adhering with an elastic fiber. As a result, unless a highly uniform mixture of the two fibers is formed during the construction of the absorbent structure, the two types of fibers tend to segregate and the benefit of the elastomeric fibers is reduced or lost.

Accordingly, the absorbent product industry has a continuing interest in the design and construction of absorbent products with improved elasticity without a compromise in absorbency. This interest extends to both the nature of the fibers from which the absorbent products are made, and the methods by which these absorbent products are constructed.

SUMMARY OF THE INVENTION

In one embodiment, the invention is a bicomponent fiber of a core/sheath construction in which the core comprises the thermoplastic elastomer, preferably a thermoplastic polyurethane (TPU), and the sheath comprises the homogeneously branched polyolefin. Preferably, the polymer of the sheath has a lower melting point than the polymer of the core, and more preferably the polymer of the sheath has a gel content of less than 30 percent.

In another embodiment, the invention is a biconstituent fiber in which one constituent comprises the thermoplastic elastomer, preferably a TPU, and the other constituent comprises the homogeneously branched polyolefin. Preferably, the constituent that forms the majority of the external surface of the fiber has a lower melting point than the other constituent, and preferably has a gel content of less than 30 percent.

In another embodiment, the invention is a blend of fibers (or simply a "fiber blend") comprising (i) an elastic fiber comprising an elastic core and an elastic sheath, and (ii) at least one fiber other than the elastic fiber of (i). The core of the elastic fiber preferably comprises a thermoplastic elastomer, preferably a TPU, and the sheath of the elastic fiber preferably comprises a homogeneously branched polyolefin, more preferably a homogenously branched, substantially linear ethylene polymer. The polymer of the sheath has a melting point below the melting point of the polymer of the core, and preferably the polymer of the sheath has a gel content of less than 30 weight percent. The fiber of (ii) is essentially any fiber other than the fiber of (i), preferably a fiber of cellulose, wool, silk, a thermoplastic polymer, silica or a combination of two or more of these. In another embodiment of the invention, the fibers of (i) are melt bonded to the fibers of (ii), preferably by exposure to a temperature that is at or slightly below the melt temperature of both the fiber of (ii) and the polymer of the core of fiber (i) but above the melt temperature of the polymer of the sheath of fiber (i). In yet another embodiment of this invention, the melt bonded fiber blend is substantially free of any added adhesives, e.g., glue.

In another embodiment of this invention, the blends described in the preceding paragraph are used to build elastic, absorbent structures. Such structures include paper with elasticity, e.g., form-fitting labels, and the absorbent padding of a disposable diaper.

In another embodiment, the invention is a fabricated article comprising elastic fiber and a nonwoven substrate, the fiber comprising at least two elastic polymers, one polymer preferably a thermoplastic elastomer, more preferably a TPU, and the other polymer a homogeneously branched polyolefin, preferably a homogeneously branched, substantially linear ethylene polymer, in which the fiber is melt bonded to the nonwoven substrate in the absence of an adhesive. Exemplary fabricated structures of this embodiment include the leg cuffs, leg gatherers, waistbands and side panels of a disposable diaper.

In another embodiment of the invention, the ratio of nonelastic staple fibers, e.g., cellulose fibers, bonded to elastic fibers versus nonelastic staple fibers bonded to other nonelastic staple fibers, is increased by a method in which the elastic fiber is a hydrophobic fiber grafted with a hydrophilic agent, e.g., a polyethylene fiber grafted with maleic anhydride. In an extension of this embodiment, and in which the hydrophilic agent is an acid or an anhydride, e.g., maleic anhydride, once the agent is grafted to the fiber it is then reacted with an amine.

In another embodiment of the invention, for those nonelastic staple fibers that bind to one another due to hydrogen bonding, e.g., cellulose fibers, the ratio of nonelastic staple fibers bonded to elastic fibers versus nonelastic staple fibers bonded to other nonelastic staple fibers is increased by treating the nonelastic staple fibers, prior to or simultaneously with blending these fibers with the elastic fibers, with a debonding agent, e.g., a quaternary ammonium compound containing one or more acid groups. The debonding agent deactivates at least a part of the hydrogen bonding between the nonelastic staple fibers.

In another embodiment of the invention, blending of nonelastic staple fibers with elastic fibers is enhanced by blending the fibers in an aqueous media, preferably in the presence of a surfactant and with intense agitation. This procedure enhances the separation of the elastic fibers from one another, and thus makes each fiber more accessible for bonding with a nonelastic staple fiber. This method can be used alone or in combination with one or more other fiber separation embodiments of this invention.

In another embodiment of the invention, high intensity air mixing is used to separate elastic fibers from one another prior to blending with staple fibers. This technique also promotes separation of the elastic fibers from one another, and this, in turn, improves their accessibility for bonding with the staple fibers. This embodiment of the invention can also be used alone or in combination with one or more other embodiments of the invention.

The three fiber separation and the grafting embodiments described above are particularly useful in the construction of elastic absorbent structures such as diapers, wound dressings and the like.

DESCRIPTION OF THE PREFERRED EMBODIMENTS

Elastic Bicomponent and Biconstituent Fibers

As here used, "fiber" or "fibrous" means a particulate material in which the length to diameter ratio of such material is greater than about 10. Conversely, "nonfiber" or "nonfibrous" means a particulate material in which the length to diameter ratio is about 10 or less.

As here used, "elastic" or "elastomeric" describes a fiber or other structure, e.g., a film, that will recover at least about 50 percent of its stretched length after both the first pull and after the fourth pull to 100 percent strain (doubled the length). Elasticity can also be described by the "permanent set" of the fiber. Permanent set is measured by stretching a fiber to a certain point and subsequently releasing it to its original position, and then stretching it again. The point at which the fiber begins to pull a load is designated as the percent permanent set.

As here used, "bicomponent fiber" means a fiber comprising at least two components, i.e., of having at least two distinct polymeric regimes. The first component, i.e., "component A", serves the purpose of generally retaining the fiber form during the thermal bonding temperatures. The second component, i.e., "component B", serves the function of an adhesive. Typically, component A has a higher melting point than component B, preferably component A will melt at a temperature at least about 20 C, preferably at least 40 C, higher than at the temperature at which component B will melt.

For simplicity, the structure of the bicomponent fibers is typically referred to as a core/sheath structure. However, the structure of the fiber can have any one of a number of multi-component configurations, e.g., symmetrical core-sheath, asymmetrical core-sheath, side-by-side, pie sections, crescent moon and the like for bicomponent fibers. The essential feature on each of these configurations is that at least part, preferably at least a major part, of the external surface of the fiber comprises the sheath portion of the fiber, i.e., the adhesive, or lower melting point, or less than 30 wt % gel, or component B, of the fiber. FIGS. 1A–1F of U.S. Pat. No. 6,225,243, the disclosure of which is incorporated herein by reference, illustrate various core/sheath constructions.

As here used, "biconstituent fiber" means a fiber comprising an intimate blend of at least two polymer constituents. The structure of the biconstituent fiber is an islands-in-the-sea construction.

The bicomponent fibers used in the practice of this invention are elastic and, each component of the bicomponent fiber is elastic. Elastic bicomponent and biconstituent fibers are known, e.g., U.S. Pat. No. 6,140,442 the disclosure of which is incorporated herein by reference.

In this invention, the core (component A) is a thermoplastic elastomeric polymer illustrative of which are diblock, triblock or multiblock elastomeric copolymers such as olefinic copolymers such as styrene-isoprene-styrene, styrene-butadiene-styrene, styrene-ethylene/butylene-styrene or styrene-ethylene/propylene-styrene, such as those available from the Shell Chemical Company under the trade designation Kraton elastomeric resin; polyurethanes, such as those available from The Dow Chemical Company under the trade designation PELLATHANE polyurethanes or spandex available from E.I. Du Pont de Nemours Co. under the trade designation Lycra; polyamides, such as polyether block amides available from Elf AtoChem Company under the trade designation Pebax polyether block amide; and polyesters, such as those available from E.I. Du Pont de Nemours Co. under the trade designation Hytrel polyester. Thermoplastic urethanes (i.e., polyurethanes) are a preferred core polymer, particularly Pellethane polyurethanes.

The sheath (the adhesive or component B) is also elastomeric, and it is a homogeneously branched polyolefin, preferably a homogeneously branched ethylene polymer and more preferably a homogeneously branched, substantially linear ethylene polymer. These materials are well known. For example, U.S. Pat. No. 6,140,442 provides an excellent description of the preferred homogeneously branched, substantially linear ethylene polymers, and it includes many references to other patents and nonpatent literature that describe other homogeneously branched polyolefins.

The homogenously branched polyolefin has a density (as measured by ASTM/D792) of about 0.91 g/cm$^3$ or less with a melting point at or below 110 C (as measured by DSC). More preferably, the density of the polyolefin is between about 0.85 and about 0.89 g/cm$^3$ with a melting point between about 50 and about 70 C. Preferably, the polyolefin has a viscosity at the melt point that permits easy flow for bonding to the staple fibers or a nonwoven fabric structure. The melt index (MI as measured by ASTM DI238 at 190 C)

for the polyolefin is at least about 30, and preferably at least about 100. Additives such as antioxidants (e.g., hindered phenolics (e.g., Irganox.RTM. 1010 made by Ciba-Geigy Corp.), and phosphites (e.g., Irgafos.RTM. 169 made by Ciba-Geigy Corp.)), cling additives (e.g., polyisobutylene (PIB)), antiblock additives, pigments and the like can also be included in the homogeneously branched ethylene polymers used to make the elastic fibers to the extent that they do not interfere with the enhanced fiber and fabric properties characteristic of this invention.

The gel content of the polyolefin is less than 30, preferably less than 20 and more preferably less than 10, weight percent. The gel content is a measure of the degree of cross-linking of the polyolefin and because a principal function of the polyolefin is to provide a meltable exterior component to the fiber for easy thermal bonding to staple fibers and/or nonwoven structures, little, if any, cross-linking of the polyolefin is preferred. In addition, usually the less cross-linked a polyolefin, the lower its melting point.

"Nonwoven structure" means a group of fibers connected together in such a fashion such that the group forms a cohesive, integrated structure. Such structures can be formed by techniques known in the art, such as air-laid, spun bonding, staple fiber carding, thermal bonding, and melt blown and spun lacing. Polymers useful for making such fibers include PET, PBT, nylon, polyolefins, silicas, polyurethanes, poly(p-phenylene terephthalamide), Lycra® (a polyurethane made from the reaction of polyethylene glycol and toluene-2,4-diisocyanate by E.I. Du Pont de Nemours & Co.), carbon fibers and natural polymers such as cellulose and polyamide.

As here used, "staple fiber" means a natural fiber or a length cut from, for example, a manufactured filament. These fibers act in the absorbent structure of this invention as a temporary reservoir for liquid and also as a conduit for liquid distribution. Staple fibers include natural and synthetic materials. Natural materials include cellulosic fibers and textile fibers such as cotton and rayon. Synthetic materials include nonabsorbent synthetic polymeric fibers, e.g. polyolefins, polyesters, polyacrylics, polyamides and polystyrenes. Nonabsorbent synthetic staple fibers are preferably crimped, i.e., fibers having a continuous wavy, curvy or jagged character along their length. Cellulosic fibers are the preferred staple fibers for reasons of availability, cost and absorbency.

In order to promote good mixing of the staple and elastic fibers, the bicomponent fibers are preferably "wetted". As here used, "wetted" or "wettable" means a fiber which exhibits a liquid in air contact angle of less than 90 degrees. These terms and the measurement of this property are more fully described in U.S. Pat. No. 5,645,542.

The wettable staple and elastic fibers are present in the elastomeric absorbent structure of this invention in an amount sufficient to impart the desired absorbent and elastic properties. Typically, the staple fiber is present in an amount from about 20 to about 80 percent by weight, preferably from about 25 to about 75 and more preferably from about 30 to about 70 percent, by weight based on the total weight of the staple fiber and elastic fiber.

Although the bicomponent and/or biconstituent fibers are used in the same manner as other elastomeric fibers for the construction of elastic, absorbent structures, preferably these fibers are used in combination with one or more of the embodiments of this invention as described below. In any instance, however, the use of a bicomponent or biconstituent fiber as the elastic fiber component of elastic, absorbent structures provides an elastic, absorbent structure with improved elasticity without compromising the absorbency of the structure. This results in lighter, thinner and/or better form-fitting structures.

Graft-modified Elastic Fibers

In this embodiment of the invention, adhesion of the elastomeric fibers to the staple fibers is enhanced by grafting to the elastomeric fiber a compound containing a polar group, such as a carbonyl, hydroxyl or acid group. This embodiment of the invention is applicable to both homofil and bicomponent or biconstituent elastomeric fibers. "Homofil" fibers are fibers comprising a single component or, in other words, are essentially homogeneous throughout their length. With respect to bicomponent and biconstituent fibers, the polar group containing compound is grafted to the sheath component (i.e., the component that forms at least a part of the exterior surface) of the fiber.

The organic compound containing the polar group can be grafted to the elastomeric fiber by any known technique, e.g., those taught in U.S. Pat. Nos. 3,236,917 and 5,194,509 of which the disclosures of both are incorporated herein by reference. For example, in the '917 patent the polymer (i.e., the elastomeric fiber polymer) is introduced into a two-roll mixer and mixed at a temperature of 60 C. An unsaturated, carbonyl-containing organic compound is then added along with a free radical initiator, such as, for example, benzoyl peroxide, and the components are mixed at 30 C until the grafting is completed. In the '509 patent, the procedure is similar except that the reaction temperature is higher, e.g. 210–300 C, and a free radical initiator is not used.

An alternative and preferred method of grafting is taught in U.S. Pat. No. 4,950,541 the disclosure of which is also incorporated herein by reference. This procedure uses a twin-screw devolatilizing extruder as the mixing apparatus. The elastomeric fiber, e.g., a polyolefin, and an unsaturated carbonyl-containing compound are mixed and reacted within the extruder at temperatures at which the reactants are molten and in the presence of a free radical initiator. In this procedure, preferably the unsaturated carbonyl-containing organic compound is injected into a zone maintained under pressure within the extruder.

The polymer from which the fiber is made is usually grafted with the polar group containing compound prior to the formation of the fiber (by whatever method is used to construct the fiber).

The polar group containing organic compounds which are grafted to the elastomeric fiber are unsaturated, i.e., they contain at least one double bond. Representative and preferred unsaturated organic compounds that contain at least one polar group are the ethylenically unsaturated carboxylic acids, anhydrides, esters and their salts, both metallic and non-metallic. Preferably, the organic compound contains ethylenic unsaturation conjugated with a carbonyl group. Representative compounds include maleic, fumaric, acrylic, methacrylic, itaconic, crotonic, alpha-methylcrotonic, cinnamic and the like, acids and their anhydride, ester and salt derivatives, if any. Maleic anhydride is the preferred unsaturated organic compound containing at least one ethylenic unsaturation and at least one carbonyl group.

The unsaturated organic compound component of the grafted elastomeric fiber is present in an amount of at least about 0.01 percent, preferably at least about 0.1 and more preferably at least about 0.5 percent, by weight based on the combined weight of the elastomeric fiber and the organic compound. The maximum amount of unsaturated organic compound can vary to convenience, but typically it does not exceed about 10, preferably it does not exceed about 5, and more preferably it does not exceed about 2, weight percent.

With respect to bicomponent and biconstituent fibers, the graft can be produced by either graft-reacting the polar group containing compound with all of the sheath component (component B1), or by using a graft concentrate or master batch (B2), i.e., the polar group containing compound mixed with the sheath component. If such a blend of components is used, then preferably component B2 is between about 5 and 50, and more preferably between about 5 and 15, weight percent of the combination of B1 and B2. The preferred concentration of the polar group containing compound in the blend is such that after blending with the sheath component, the final mixture has a final polar group containing concentration of at least 0.01 percent by weight, and preferably at least about 0.1 percent by weight.

In those situations in which a graft concentrate is used with respect to a bicomponent fiber, preferably the graft concentrate (B2), is of a lower viscosity than the matrix adhesive material (B1). This will enhance migration of the graft component to the surface of the fiber during passage of the material through a fiber-forming die. The object, of course, is to enhance the adhesion of the bond fiber to the staple fiber by enhancing the concentration of the graft compound to the fiber surface. Preferably, the melt index of component B2 is between 2 and 10 times the melt index of component B1.

Deactivation of Cellulose Hydrogen Bonds

In another embodiment of the invention (an embodiment in which the staple fibers are cellulose fibers), the elastic performance of the absorbent elastic structure is enhanced through the promotion of more cellulosic-elastic fiber bonds at the expense of cellulosic-cellulosic fiber bonds. In this embodiment, the cellulosic staple fibers are treated either prior to or simultaneously with their mixing with the elstomeric fibers with a debonding agent. These bonds and their disruption were described in a presentation given by Craig Poffenberger entitled "Bulk and Performance, But Soft and Safe" at the Insight 2000 Non-wovens/Absorbents Conference held in Toronto from Oct. 30 through Nov. 2, 2000. With the decoupling of these hydrogen bonds, more cellulose fiber is available to bond with the elastic fiber and the more cellulose-elastic fiber bonds that are formed, the more elastic is the resulting absorbent structure.

Compounds that are useful in decoupling inter-fiber hydrogen bonds of cellulose fibers include quaternary ammonium compounds containing one or more acid or anhydride groups. Typical of these compounds are difattydimethyl, imidazolinum, N-alkyldimethylbenzyl and dialkoxylated alkyldimethyl. The debonding agent is used in an amount of about 0.01 to about 10 percent by weight based on the weight of cellulose fiber to be treated. Another compound that is useful in decoupling cellulose-cellulose hydrogen bonding is AROSURF PA-777, a surfactant manufactured by Goldschmidt Corp.

This embodiment of the invention can be used alone or in combination with one or more of the other embodiments of the invention.

Agitation in a Water Media to Separate Elastic Fibers

In this embodiment of the invention, the elastic fibers are separated from one another by agitation in a water media. Elastic fibers, typically fine denier elastic fibers, are difficult to separate from one another and as such, are difficult to blend uniformly with staple fibers during the construction of an elastic absorbent structure. As here used, "fine denier" elastic fiber means an elastic fiber having a diameter of less than about 15 denier per filament. Fibers are typically classified according to their diameter, and monofilament fiber is generally defined as having an individual fiber diameter greater than about 15 denier, usually greater than about 30 denier. Microdenier fibers are generally defined as fiber having a diameter of less than about 100 microns.

In this embodiment, the elastic fibers are placed in an aqueous media, and then are subjected to vigorous agitation by any conventional means, e.g. mechanical stirrer, jet pump, etc. Surfactants and/or wetting agents can be employed and after the elastic fibers have sufficiently separated from one another, the staple fibers can be added. In a preferred embodiment of this invention, the staple fibers are added in combination with a debonding agent. After a homogeneous blend of the elastic and staple fibers has been formed, the water is removed, typically by filtering followed by exposure to heat, e.g. time in an oven. Once sufficiently dry, the resulting fluff pulp is ready for processing into an elastic absorbent structure. At this point, various additives, e.g. super absorbent powder, can be added to the pulp. During the drawing step, care is required to avoid warming the fibers to a temperature that would prematurely activate/melt the bond fibers.

This particular embodiment is also useful with any elastomeric fiber of any composition and structure (including homofil fibers), and it is also useful with any staple fiber.

High Intensity Air Mixing

In this embodiment of the invention, the elastomeric fibers are separated from one another using a high intensity air mixing technique. This technique is similar to the agitation in a water media technique described above, except it does not employ an aqueous media (or for that matter, any liquid media). The elastomeric fiber, either homofil or bicomponent, is subjected to intense agitation, either mechanically or through pneumatic means, and once sufficiently separated, and in a further embodiment of this invention, blended with the staple fibers. While this technique avoids the need for drying the resulting blend of fibers, it does not lend itself well to use in combination with a debonding agent for the cellulosic fibers, or surfactants and/or wetting agents for use with the elastomeric fibers. Here too, however, this embodiment can be combined with one or more other embodiments of the invention, e.g., use of bicomponent or biconstituent elastomeric fibers, graft-modified elastomeric fibers, and cellulosic fibers of which the hydrogen bonding between fibers has previously been deactivated.

Elastic Absorbent Structure Construction

The elastic absorbent structure of this invention can be constructed from a blend of staple fibers and bicomponent and/or biconstituent elastic fibers of a core/sheath construction in which the core is a thermoplastic urethane and the sheath is a homogeneously branched polyolefin. According to this embodiment, the blend of staple and elastic fibers is prepared in any conventional manner and/or using any one of the inventive techniques described above and, optionally, is subsequently admixed with one or more super-absorbent polymers. This admixture is also performed using conventional technology but due to the presence of the low melt temperature adhesive component in the bicomponent or biconstituent fiber (i.e., the homogeneously branched polyolefin), the fluff pulp can be bonded together with heat as low as about 70 C to form an elastic absorbent structure, e.g. a diaper. The lower melt point of the adhesive component of the elastic bond fibers allows the use of currently-in-use commercial equipment but at a lower temperature which, in turn, means the faster production rates are achieved over both monofil elastomeric fibers and bicomponent elastomeric fibers in which the adhesive component has a higher melt temperature. However, the lower melt temperature and/or faster bond rate reduces or alleviates the problems of bond fiber activation in, or in-line with, the structure making machines, e.g., a diaper-making machine.

In conventional absorbent cores or structures, the cellulosic fibers are typically bonded to one another using latex. The latex often collects at the cellulosic fiber interfaces and, upon curing, holds the cellulosic fibers together. The use of a bicomponent or biconstituent bond fiber with two distinct regimes, e.g., a core and sheath, make for a better bond system. The core has a melting point above the oven temperature, and the sheath has melt point below the oven temperature. The bicomponent and biconstituent fibers efficiently fuse to the cellulosic fibers wherever they touch. The connections between the cellulosic fibers are thus longer than just the size of the fusion joints. This, in turn, produces a more flexible structure.

Homogeneously branched ethylene polymers, particularly homogeneously branched, substantially linear ethylene polymers, make excellent sheath materials because their melting point is lower than many other elastic polymeric materials. Preferably, the sheath material will melt at least about 20 C, more preferably at least about 40 C, below the melt point of the core material.

Elastic Paper Construction

Bicomponent and biconstituent elastic bond fibers are useful in the production of elastic paper, i.e., paper with some degree of elasticity. As described above, these elastic bond fibers for elastic paper comprise an elastic polyurethane core with an elastic homogeneously branched polyofelin, more preferably a homogeneously branched polyolefin grafted with maleic anhydride or similar compound. If these bicomponent elastic fibers are mixed with cellulose fibers without interrupting the cellulose-cellulose hydrogen bonds, then the addition of these bicomponent or biconstituent elastic fibers will reduce tensil and provide some measure of elasticity, but the paper will tear at five percent strain. In other words, the benefit of the addition of bicomponent and/or biconstituent elastic fiber is minimized if the cellulose-cellulose hydrogen bonds are not interrupted.

If, however, the cellulose-cellulose hydrogen bonds are interrupted with bicomponent or biconstituent elastic fiber, then the resulting paper exhibits a marked drop in tensil, significant elastic recovery, and resists tear at five percent strain. The cellulose-cellulose hydrogen bonds can be interrupted as taught above.

To maximize the benefit of the disrupted cellulose-cellulose hydrogen bonds, good dispersion of the bicomponent elastic fiber with the cellulosic fiber is desired. Dispersion of the bicomponent elastic fiber within the cellulose fiber matrix is enhanced by separating the elastic fiber bundles prior to mixing with the cellulose fibers. Here too, the separation of fiber bundles is facilitated by either the dry (i.e., high intensity air agitation) or wet separation methods taught above, with the dry separation method preferred over the wet separation method.

The elasticity of the paper is also influenced by the structure of the fibers. Low modulus elastic fibers provide good fabric performance, but are awkward to process. Long bond fibers (i.e., bicomponent and biconstituent elastic fibers) mixed with short matrix fibers (i.e., cellulose fibers) produce a paper with better elasticity (i.e., less intersectional bonding) but the complete dispersion is more difficult because the long flexible elastic fibers twist easily which make them difficult to unbundle. However, if the elastic bond fibers are thick, they make for a better dispersion although they have an adverse impact on the economics. In sum, a preferred balance of elasticity and dispersion results from the use of a mix of low modulus fibers, the bond fibers of which are long and thick and the matrix fibers are short.

In addition, the amount of elastic fibers in the paper also has an impact on the paper strength and elasticity. Too few bicomponent or biconstituent elastic bond fibers results in poor bonding of the other fibers into the fabric which results in a paper with poor strength and elasticity. Too many such elastic bond fibers results in too many intersectional bonds and while the paper strength is good, its elasticity is poor. The negative effect of too many bicomponent elastic bond fibers can be reduced, however, by using a higher loft in the paper construction.

The following examples are illustrative of certain of the embodiments of this invention described above. All parts and percentages are by weight unless otherwise noted.

SPECIFIC EMBODIMENTS

EXAMPLE 1

Graft Modification of Polyethylene

A substantially linear ethylene/1-octene polymer (MI-73, density-0.87 g/cm$^3$) is grafted with maleic anhydride to produce a material with a MI of 34.6 and a 0.35 weight percent content of units derived from maleic anhydride. The grafting procedure taught in U.S. Pat. No. 4,950,541 is followed. The grafted polyethylene is used as a graft concentrate, and is let down 2:1 with an ethylene/1-octene polyolefin with an MI of 30 and a density of 0.87 g/cm$^3$. The resulting let-down material is used to form the sheath (adhesive component) of the bicomponent elastic fiber used in the following examples.

EXAMPLE 2A

Fiber Separation Using Intensive Mixing in an Aqueous Medium

Bicomponent, 11.2 denier elastic fiber comprising 50 percent Pellathane™ 2103-80PF (an elastomeric thermoplastic polyurethane manufactured by The Dow Chemical Company) and 50 percent homogeneously branched, substantially linear ethyline/1-octene polyolefin is prepared as described in Example 1 above. The thermoplastic polyurethane forms the core and the MAH-grafted ethylene polymer forms the sheath of the bicomponent fiber. A mixture of 30 percent of this elastomeric bond fiber and 70 percent Hi Bright cellulose fibers (unbeaten, bleached kraft softwood, macerated and soaked overnight at 1.1 percent in water) in 5 liters of water with 5 grams surfactant (Rhodameer, Katapol VP-532) and 110 grams of 0.5 percent solid Magnafloc 1885 anionic polyacrylamide viscosity modifier is added to a Waring blender. The mixture is stirred to produce a substantially uniform mixture of elastic and cellulose fibers which are subsequently formed into an elastic, absorbent paper.

EXAMPLE 2B

Fiber Separation Using Intensive Mixing in an Aqueous Medium and Hydrogen Bonding Deactivation

| Sample Designation | Core/Sheath Composition* | Denier |
|---|---|---|
| 1.2 | TPU/Engage (30 MI) | 6.78 |
| 1.3 | TPU/MAH-g-Engage (30 MI) | 11.32 |
| 2.2 | TPU/Engage (30 MI) | — |
| 3.2 | TPU/Engage (18 MI) | 6.4 |
| 3.3 | TPU/Engage (18 MI) | 11.4 |

Initially, all of the five fiber systems (tows) listed above are cut to ⅛" length using a scissors. A 100 g/m$^2$ air laid pad with 12% binder fiber loading needs to incorporate 0.43 g of binder fiber by weight. Sufficient amount of fiber is cut in all cases to produce 3 pads.

Following the cutting of the fiber tows (each tow has 72 individual fiber filaments) to length, the next step is to separate individual fibers from the tows so that these can be incorporated into cellulose pulp and air laid into a pad. The sheath polymer(s) in all the cases are quite "tacky" even at room temperature (0.870 g/cc density) and the individual fibers are completely "fused" together in all cases over time.

To separate the fiber tows into individual filaments, 0.43 g of binder fiber is weighed and added to a Waring™ blender. To this is added 2.00 g of cellulose pulp (a total of 3.195 g of cellulose pulp is used in a 100 gsm pad). Next, a 25:1 solution of water with AROSURF™ PA-777 surfactant blend from Goldschmidt Corp. is added to the binder fiber plus cellulose pulp mix. The blender is activated for 2–3 seconds and during this time the binder fiber tows instantaneously "open" up into individual fiber filaments. The cellulose pulp is added to the above mix to ensure that the binder fiber filaments stay separated during the subsequent drying process. The above procedure not only enables the separation of binder fiber into individual filaments, but it also results in deactivating the hydrogen bonding in pulp.

The next step entails drying the binder fiber and pulp mixture. The fibers are first separated from the water/surfactant solution using a sieve. This fiber mixture is then dried overnight in a vacuum oven at 50° C. to ensure that any residual moisture is also removed. The dried fiber mixture is then incorporated into the air-laid chamber (an additional 1.195 gms of "deactivated" and dried cellulose pulp is also added at this time) and an absorbent pad structure is made using a vacuum assist process.

EXAMPLE 3

Elastic Paper Comparison

Eight inch by eight inch (8"×8") elastic paper samples are prepared by using the procedure of Example 2. Samples 3.1 and 3.2 both comprise 100 percent Hi Bright cellulose fiber. Examples 3.3 through 3.8 are made from varying percentages of Hi Bright cellulose fiber and the elastic bicomponent fiber described in Example 2 above. Samples 3.9 and 3.10 contain a third fiber component, i.e. nylon fiber. The paper samples are made using a Noble & Wood paper-making machine.

Sample 3.4 is prepared by presoaking 0.9 grams of the bicomponent fiber in 50 cc of water plus 5 drops of Katapol surfactant (VP-532), and then it is soaked for another five minutes before the addition of 190 cc of Hi Bright fibers. The rationale for this procedure is to use the thickening effect of the cellulose fibers to break up the clumps of the bicomponent fiber. The Waring blender is run at 1500 rpm. The resulting paper, which is dried on an Emerson apparatus at 250 F, still has visible clumps of bicomponent fibers. However, when the paper is torn, the tear is between bonded elastic fibers.

The paper of Sample 3.5 is prepared in essentially the same manner as that of Sample 3.4 except that some of the clumps of the bicomponent fiber are broken up in a dry state within the Waring blender (an example of high intensity air agitation). After these clumps arc broken up, 50 cc of water with five drops of Katapol are added to the blender and the mixture is stirred again at a low setting. Subsequently, 190 cc of Hi Bright cellulose fiber with another 100 cc of water are added to the mixture, and stirred for an additional 5 minutes at 1000 rpm. The paper of this sample has less visible clumps, and the tear occurs between bonded elastic fibers.

Sample 3.6 paper is about 70 pound grade made with the same cellulose pulp content of the previous samples, i.e., 190 cc. Two grams of bicomponent fiber are added to and then broken up in a Waring blender on a dry basis (i.e., in the absence of an aqueous media) at a low setting for one and a half minutes (this procedure is repeated three times with a scrape-down of the blender walls between each stirring). One hundred milliliters of water are subsequently added with five drops of Katapol, the resulting mixture is once again stirred at a low setting for one minute, and then it is combined with 190 cc of Hi Bright cellulose, fibers plus enough water to make 600 cc of total mixture. This total mixture is then transferred to a beaker and stirred at 1500 rpm for two minutes. Paper made from this mixture demonstrates some elasticity before tear.

Sample 3.7 is a repeat of sample 3.6 except 2.4 grams of bicomponent fiber is used instead of 2.0 grams.

Sample 3.8 is a repeat of sample 3.7 except an anti-foam is added with the Katapol (Foammaster VF made by Diamond Shamrock, 3 drops).

Sample 3.9 is a repeat of sample 3.8 except 5 grams of 0.080 SD nylon fibers from Microfibers of Pawtucket, R.I. are also added. The nylon is added with 100 cc of water, and it produces a high dispersion with almost no stirring. She nylon-water mixture is added to the bicomponent fiber-Hi Bright mixture and the total mixture of 600 cc is stirred at 1500 rpm for two minutes. The purpose of the nylon addition is to facilitate the break-up of the bonding between the cellulose fibers.

Sample 3.10 is a repeat of Sample 3.9 except 2.4 grams of bicomponent fiber, 20 drops of Katapol, 6 drops of antifoam, 2 grams of nylon fibers and 100 cc of Hi Bright cellulose fibers (about 1.1 grams) are used.

The particulars of the samples and the results of their testing on an Instron instrument are reported in the following Table.

SUMMARY OF ELASTIC PAPER DATA

| | Grams (and %) per 8" × 8" Paper Sample | | | | | @ 5% strain (0.10 inch displ.), Instron (1" wide, 2" jaw space) | | | | | |
|---|---|---|---|---|---|---|---|---|---|---|---|
| | | | | | | | Lb (Avg of 2 Tests) | | | Initial | |
| Sample Number | Pulp | Bico Fiber | Nylon Fiber | Total | Drops Katapol | Tore, Yes/No | Peak Tensile | 2nd Pull, @ 5% strain | 2nd Pull @ 5% strain, % of Peak | 'steep' displ., inch | 2nd Pull initial displ, inch |
| 3.1 | 3 (100%) | 0 | 0 | 3 | 0 | Y, Y | 9.00 | 0.00 | 0 | 0.018 | Total rip |
| 3.2 | 2.1 (100%) | 0 | 0 | 2.1 | 0 | Y, Y | 5.55 | 0.00 | 0 | 0.018 | Total rip |

-continued

SUMMARY OF ELASTIC PAPER DATA

| | Grams (and %) per 8" × 8" Paper Sample | | | | | @ 5% strain (0.10 inch displ.), Instron (1" wide, 2" jaw space) | | | | | |
|---|---|---|---|---|---|---|---|---|---|---|---|
| | | | | | | | Lb (Avg of 2 Tests) | | | Initial | |
| Sample Number | Pulp | Bico Fiber | Nylon Fiber | Total | Drops Katapol | Tore, Yes/No | Peak Tensile | 2nd Pull, @ 5% strain | 2nd Pull @ 5% strain, % of Peak | 'steep' displ., inch | 2nd Pull initial displ, inch |
| 3.3 | 2.1 (70%) 0.059 | 0.9 (30%) | 0 | 3 | 0 | Y, Y | 4.50 | 0.15 | 3 | 0.018 | — |
| 3.4 | 2.1 (70%) | 0.9 (30%) | 0 | 3 | 5 | Y, Y | 2.30 | 0.20 | 9 | 0.023 | 0.062 |
| 3.5 | 2.1 (70%) | 0.9 (30%) | 0 | 3 | 5 | Y, Y | 2.65 | 0.58 | 22 | 0.022 | 0.045 |
| 3.6 | 2.1 (51%) | 2 (49%) | 0 | 4.1 | 5 | — | 2.35 | 0.55 | 23 | 0.014 | 0.044 |
| 3.7 | 2.1 (47%) | 2.4 (53%) | 0 | 4.5 | 5 | — | 2.80 | 1.10 | 39 | 0.019 | 0.045 |
| 3.8 | 2.1 (47%) | 2.4 (53%) | 0 | 4.5 | 5+ antifoam | — | 3.45 | 2.15 | 62 | 0.023 | 0.038 |
| 3.9 | 2.1 (42%) | 2.4 (48%) | 0.5 (10%) | 5 | 20+ antifoam | — | 3.05 | 0.65 | 21 | 0.018 | — |
| 3.10 | 1.1 (20%) | 2.4 (44%) | 2 (36%) | 5.5 | 20+ antifoam | Y, N | 0.85 | 0.50 | 59 | 0.023 | 0.038 |

Although the invention has been described in detail by the preceding examples, the detail is for the purpose of illustration and is not to be construed as a limitation upon the invention. Many variations can be made upon the preceding examples without departing from the spirit and scope following claims.

What is claimed is:

1. A fiber blend comprising (A) an elastic fiber with a core/sheath construction, the elastic fiber comprising at least two polymers, the core comprising a thermoplastic elastomer and the sheath comprising a homogeneously branched, ethylene polymer, the sheath polymer having a gel content of less than 30 wt %, and (B) at least one inelastic fiber.

2. The fiber blend of claim 1 in which the inelastic fiber is at least one of a cellulosic fiber, wool, silk and a silicate fiber.

3. The fiber blend of claim 1 in which the fiber of (A) is melt bonded to the fiber of (B).

4. A fabricated article comprising the fiber blend of claim 1.

* * * * *